United States Patent [19]

Mazumder

[11] Patent Number: 4,878,773

[45] Date of Patent: Nov. 7, 1989

[54] RIBBON FEED CONTROL APPARATUS AND METHOD

[75] Inventor: Ali T. Mazumder, Waterloo, Canada

[73] Assignee: NCR Corporation, Dayton, Ohio

[21] Appl. No.: 203,962

[22] Filed: Jun. 8, 1988

[51] Int. Cl.[4] ..... B41J 33/34

[52] U.S. Cl. ..... 400/234; 400/225; 400/232; 400/236.2; 242/75.44; 242/75.51; 242/203

[58] Field of Search ..... 400/223, 225, 231, 232, 400/234, 236, 236.2, 247, 703, 711; 242/75.4, 75.43, 75.44, 75.5, 75.51, 89, 190, 201, 202, 203, 204; 360/72.3, 74.3, 93, 95, 96.1

[56] References Cited

U.S. PATENT DOCUMENTS

| | | | |
|---|---|---|---|
| 3,662,937 | 5/1972 | Borman | 360/96.1 |
| 3,804,227 | 4/1974 | Cappoti et al. | 197/151 |
| 3,954,167 | 5/1976 | Kranz et al. | 197/165 |
| 4,010,839 | 3/1977 | Guerrini et al. | 197/151 |
| 4,013,160 | 3/1977 | Colecchi et al. | 197/151 |
| 4,019,618 | 4/1977 | Busch | 197/161 |
| 4,025,830 | 5/1977 | Delaporte | 318/6 |
| 4,074,799 | 2/1978 | Hishida et al. | 197/151 |
| 4,082,210 | 4/1978 | Gottschlich | 226/91 |
| 4,131,374 | 12/1978 | Porterfield | 400/232 |
| 4,132,485 | 1/1979 | Hess | 400/208 |
| 4,147,439 | 4/1979 | Colecchi | 400/208 |
| 4,264,224 | 4/1981 | Mathews | 400/235 |
| 4,278,020 | 7/1981 | Oaten | 101/93.05 |
| 4,313,683 | 2/1982 | Brown et al. | 400/225 |
| 4,386,379 | 5/1983 | Smith et al. | 360/72.3 |
| 4,550,885 | 11/1985 | Graham | 242/204 |
| 4,564,303 | 1/1986 | Rosenberg et al. | 400/208 |
| 4,573,645 | 3/1986 | Harris, Jr. | 242/75.47 |
| 4,606,662 | 8/1986 | Komplin | 400/214 |
| 4,615,628 | 10/1986 | Swinburne | 400/242 |
| 4,624,588 | 11/1986 | Bivin | 400/105 |
| 4,636,887 | 1/1987 | Kato et al. | 242/75.44 |
| 4,650,351 | 3/1987 | Engle et al. | 400/120 |
| 4,672,476 | 6/1987 | Saito et al. | 360/95 |
| 4,673,141 | 6/1987 | Mazumder et al. | 242/75.47 |
| 4,712,113 | 12/1987 | Brooks et al. | 346/1.1 |

FOREIGN PATENT DOCUMENTS

| | | | |
|---|---|---|---|
| 144990 | 11/1981 | Japan | 400/234 |
| 272186 | 12/1986 | Japan | 400/232 |

*Primary Examiner*—David A. Wiecking

*Attorney, Agent, or Firm*—Wilbert Hawk, Jr.; Albert L. Sessler, Jr.

[57] ABSTRACT

Ribbon feed control apparatus includes a rotatable supply roll on which a supply of ribbon to be dispensed is placed, a rotatable take-up roll on which the ribbon is collected after being used in printing, a mechanism for driving the take-up roll in one direction for pulling the ribbon from the supply roll, a device for determining the amount of ribbon required for a printing operation, a device for measuring the amount of ribbon used in such an operation, a device for comparing the amount of ribbon required with that actually used, and for terminating operation of the take-up roll driving mechanism when the amount required and the amount used are equal, tension sensing mechanism for determining when the ribbon becomes slack while it is being driven between the supply roll and the take-up roll, driving mechanism controlled by the tension sensing mechanism for driving the supply roll in a direction opposite to the direction in which the take-up roll is driven in order to take up the slack in the ribbon, and delay mechanism operable to keep the supply roll drive mechanism from operating until after the take-up roll driving mechanism has completed its operation.

1 Claim, 5 Drawing Sheets

FIG. 1
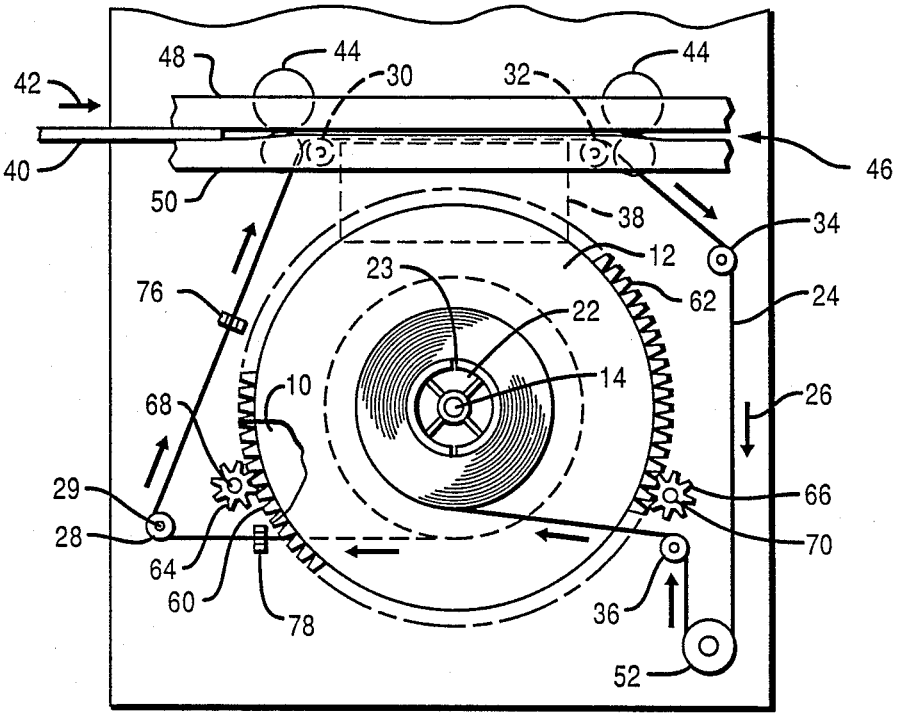
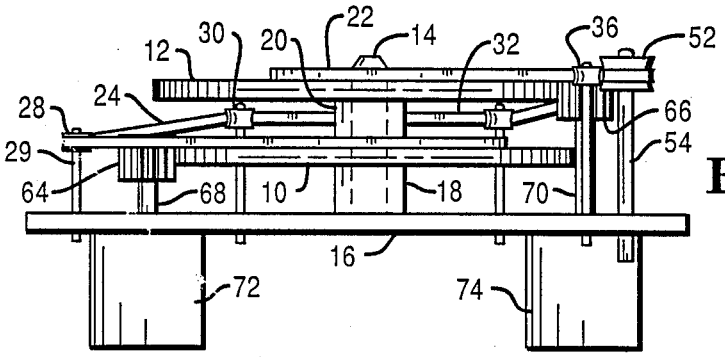
FIG. 2
FIG. 4
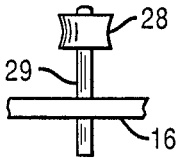
FIG. 3
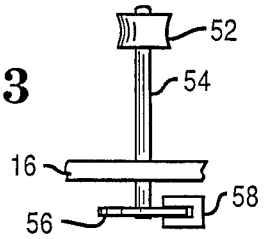

RIBBON FEED CONTROL APPARATUS AND METHOD

BACKGROUND OF THE INVENTION

In high-speed printing apparatus, such as high-speed magnetic ink character recognition (MICR) encoders in which the print speed may exceed 300 documents per minute, advancing and controlling of the ink ribbon used in such apparatus is a major problem, which becomes more difficult as speed increases.

In all high-speed MICR printers, the consumption of ribbon is very high. Therefore, the quantity of ribbon on the ribbon supply roll is very high. Since the mass of such ribbon is large, the moment of inertia is also very large. Initially a large force is required to move the ribbon, due to its relatively large mass on the supply roll. Ribbon breakage is a common problem, due to the necessity for application of a large pulling force on a large mass. Once the ribbon starts moving, the large inertial force of the ribbon supply keeps it moving. A high degree of precision and a well-controlled braking mechanism are required to keep the ribbon from becoming slack along its path from the supply roll to the take-up roll.

SUMMARY OF THE INVENTION

This invention relates generally to ribbon feed control apparatus and more specifically relates to such apparatus which may be used in very high speed magnetic ink character recognition (MICR) encoders.

In accordance with one embodiment of the invention, ribbon feed control apparatus comprises apparatus support means; ribbon supply means on which a supply of ribbon may be placed, said ribbon supply means being rotatably mounted on said apparatus support means; ribbon take-up means rotatably mounted on said apparatus support means; first drive means for driving said ribon take-up means in a first direction of rotation; ribbon advance timer means for controlling operation of said first drive means; second drive means for driving said ribbon supply means in a second direction of rotation; ribbon tension means for controlling operation of said second drive means; guide means for guiding said ribbon in a path from said ribbon supply means to said ribbon take-up means; control means for providing information as to the distance which said ribbon is to be advanced during a given operation; measuring means for measuring the distance which said ribbon is actually advanced during a given operation; comparison means coupled to said control means, said measuring means and said ribbon advance timer means for providing a halt signal to said ribbon advance timer means when ribbon distance information provided by said control means and by said measuring means are equal; adjustable delay means comrpising coupled resistor means, including a potentiometer, and capacitor means for determining time duration, said adjustable delay for controlling initiation of operation of said ribbon tension means after a predetermined time period greater than zero following termination of operation of said first drive means; and ribbon tension sensing means coupled to said ribbon tension means for causing operation of said ribbon tension means when said ribon in said path between said ribon supply means and said ribbon take-up means is slack, whereby said ribbon tension means is operable to operate said second drive means to drive said ribbon supply means in said second direction of rotation to take-up said slack after expiration of said predetermined time period greater than zero.

It is accordingly an object of the present invention to provide a ribbon feed control apparatus which may be used in high speed printers.

Another object is to provide a ribbon and control apparatus which includes mechanism for controlling ribbon slack.

Another object is to provide a ribbon feed control apparatus having ribbon supply and take-up rolls in which ribbon slack is controlled by driving the supply roll in a direction opposite to that in which the take-up roll is driven.

Another object is to provide a ribbon feed control apparatus in which the amount of ribbon to be fed in a print operation is determined before ribbon feed commences, and is controlled by measurement of the ribbon actually fed and comparison of that amount with the amount to be fed.

With these and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIG. 1 is a plan view of a ribbon feed control apparatus.

FIG. 2 is an elevation view of the ribbon feed control apparatus of FIG. 1.

FIG. 3 is a fragmentary view of the apparatus for measuring the ribbon as it is moved from the supply roll to the take-up roll.

FIG. 4 is a fragmentary view of one of the pulleys which are employed to define the path of movement of the ribbon.

DESCRIPTION OF THE PREFERRED EMBODIMENT

Figure 5:
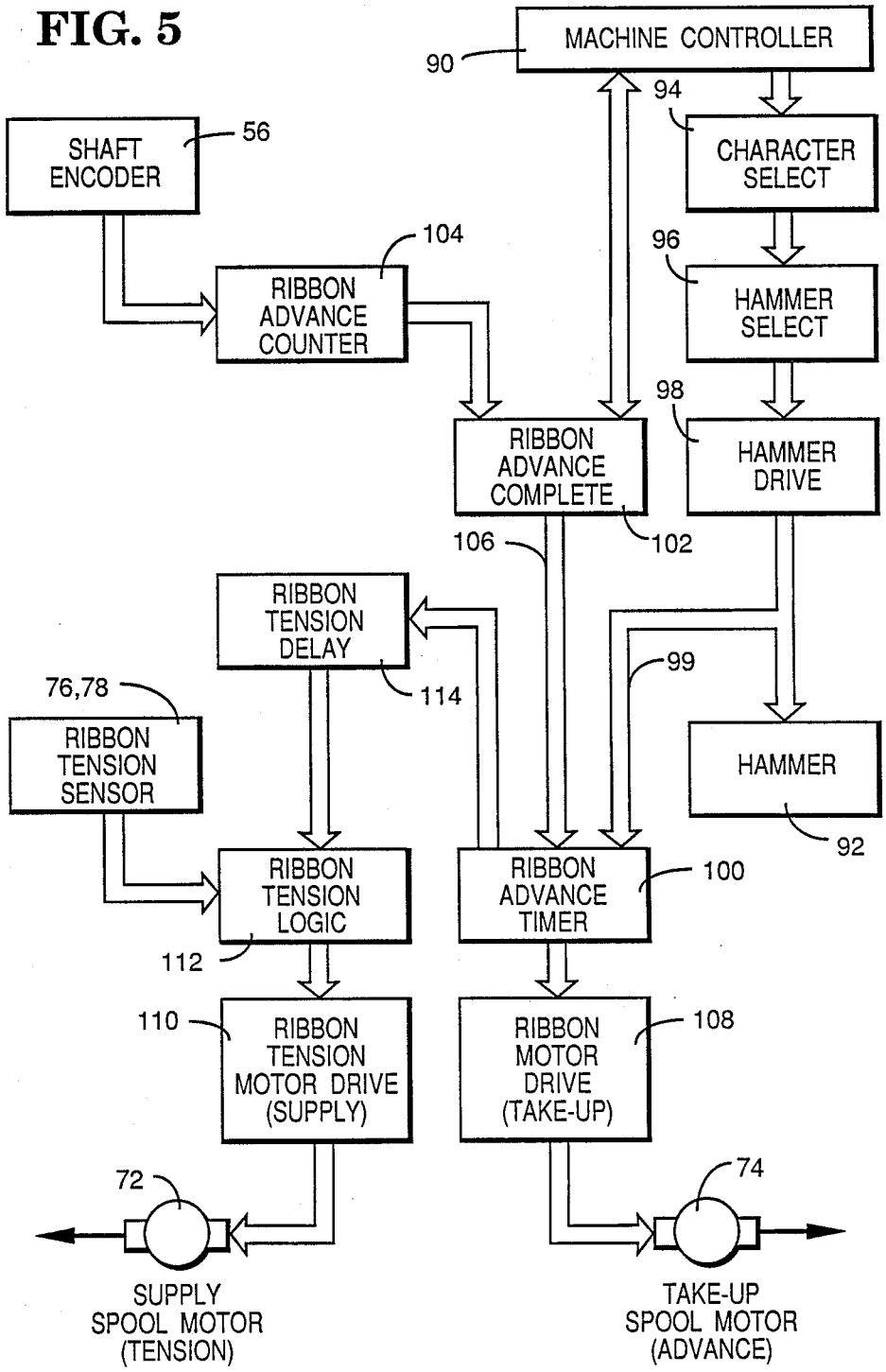
FIG. 5 is a functional block diagram of the operating circuitry for the ribbon feed control apparatus.

Referring now to FIGS. 1 and 2 of the drawings, a supply roll or spool 10 and a take-up roll or spool 12 are shown as being mounted coaxially on a common shaft 14 which is fixed in a support member or base 16. In the illustrated embodiment, the roll 10 is 7.5 inches in diameter, and can accommodate a 6,500 foot length of ribbon one quarter inch in width and approximately six ten-thousandths of an inch thick. The rolls 10 and 12 are free to rotate on the shaft 14. The supply roll 10 is spaced from the base 16 by a first spacer 18, and the take-up roll 12 is spaced from the supply roll 10 by a second spacer 20. A core 22 is placed upon the shaft 14 to receive the ink ribbon 24 which is collected on the take-up roll 12. Slots 23 are provided in the core 22 to receive an end of the ink ribbon 24 to enable it to be wound on the take-up roll 12. The ink ribbon 24 is originally disposed on the supply roll 10 and follows a path indicated by arrows such as arrow 26 between the supply roll 10 and the take-up roll 12, on which it is collected. The ribbon path changes levels from the supply roll 10 to the take-up roll 12 and is defined by guide pulleys 28, 30, 32, 34 and 36, each of which is rotatably mounted on a shaft 29 of appropriate height journalled in the base 16, as is shown in FIG. 4. This path takes the ribbon past a printing station 38 where it is used to print indicia on a document 40 which is transported to the printing station 38 in a direction indicated by the arrow 42 by drive rollers 44 located in a document track 46 which includes walls 48 and 50. Also defining the path of the ribbon 24 is a pulley 52 (also shown in FIG. 3), the rotation of which, by the moving ribbon 24, enables the measurement of the amount of ribbon fed during a printing operation. The pulley 52 is fixed to a shaft 54 journalled in the base 16. A timing disc 56 is also attached to the shaft 54 and is located in operative relationship to a sensor 58. Markings on the disc 56 are sensed by the sensor 58 and this information is transmitted to the operating circuitry of the apparatus, as will subsequently be described in greater detail, so as to provide needed information as to the length of ribbon which has been fed.

Both of the rolls 10 and 12 are provided with circumferential teeth 60 and 62, respectively, which engage with gears 64 and 66. In the illustrated embodiment, the teeth are approximately 3/16 inches high, with ⅛ inch pitch. The gears 64 and 66 are driven through shafts 68 and 70 by dc motors 72 and 74 secured to the base 16. It will be noted that the motor 72 drives the supply roll 10 in a counterclockwise direction as viewed in FIG. 1, while the motor 74 drives the take-up roll 12 in a clockwise direction, as viewed in FIG. 1.

Sensors 76 and 78 are located on the base 16 adjacent the path of the ribbon 24 for detection of whether or not the ribbon 24 is tensioned as it moves along the path from the supply roll 10 to the take-up roll 12. If the ribbon becomes slack during feeding, this is detected by the sensors 76 and 78, and this information is transmitted to the operating circuitry of the ribbon feed control apparatus. Any suitable type of sensor may be employed, such as, for example, a U-shaped device in which a light source is positioned in one leg of the U, a light detector is positioned in the other leg of the U, and the ribbon rides between the two legs. Such a sensor may be, for example, of type TIL145, manufactured by Texas Instruments Inc. When properly tensioned, the ribbon blocks the light path between the source and the detector. When the ribbon slackens, it falls so that it no longer blocks the light path, which results in a signal being generated by the detector. This signal continues until the ribbon is once again placed under proper tension, at which time it once more blocks the light path between the source and the detector, and thereby terminates the signal.

Figure 7A:
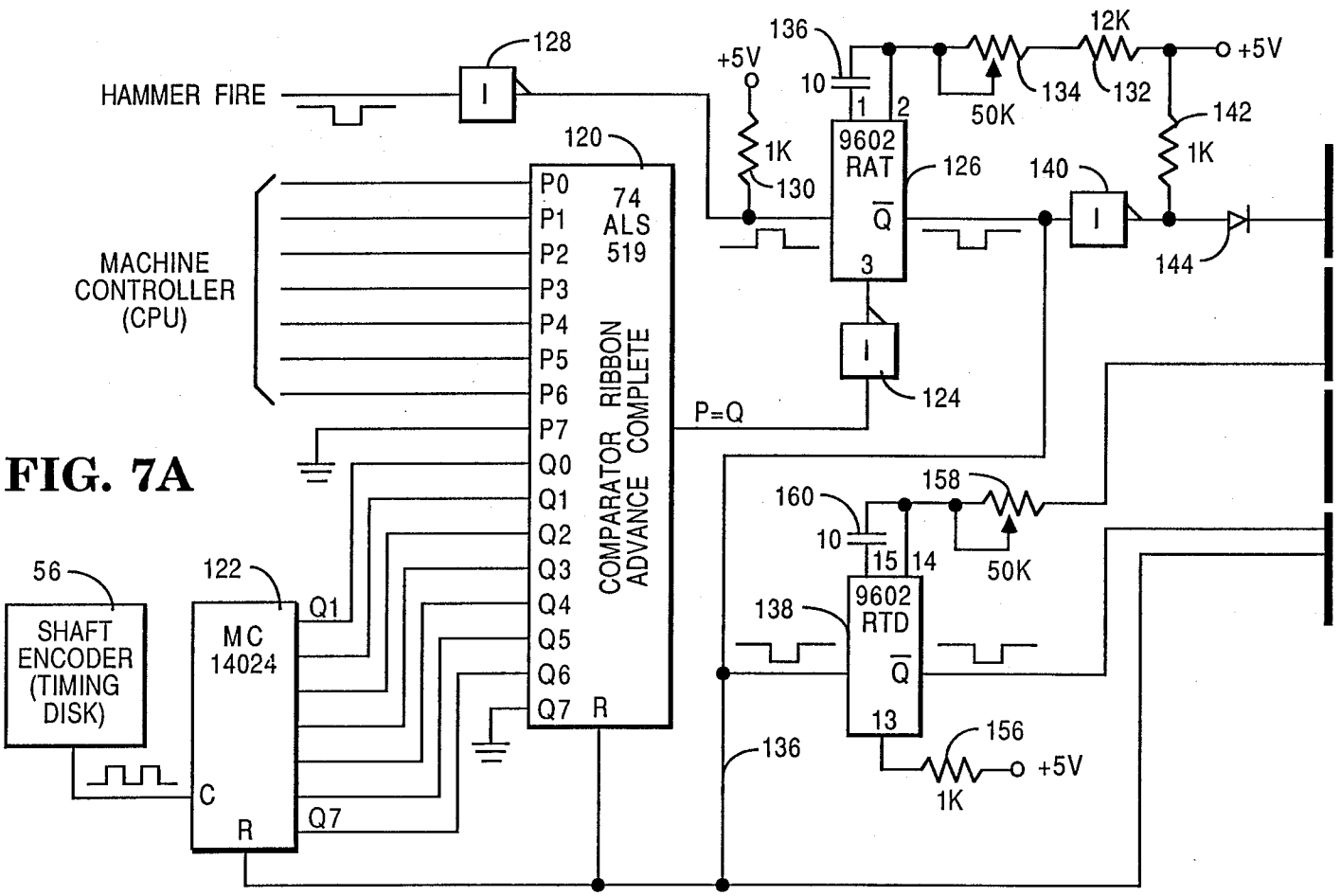
FIGS. 7A and 7B, taken together, constitute a circuit diagram of the operating circuitry for the ribbon feed control apparatus.
Figure 7B:
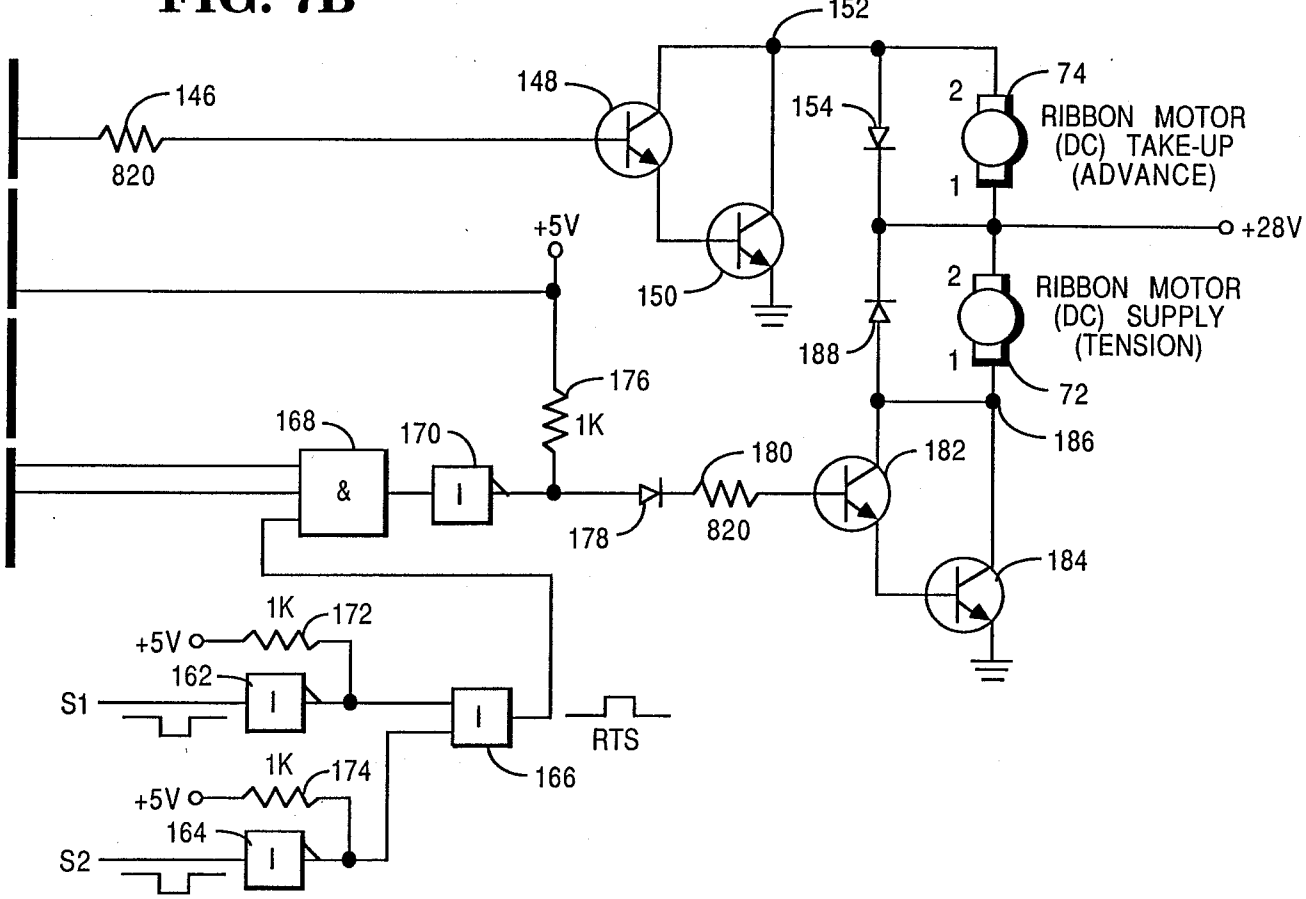

Control circuitry for the apparatus of the present invention, is shown in block form in FIG. 5, and in circuit form in FIGS. 7A and 7B. Referring now to FIG. 5, it is seen that a machine controller 90, which may be a central processing unit for the printer, controls both printer hammer action and printer ribbon advancement. This is done in accordance with information furnished to the controller 90 by another data processor, a human operator, or other suitable means. Such information may include character selection, number of characters, type font and other needed data.

The machine controller 90 controls one or more printer hammers represented by block 92 through a character select circuit 94, a hammer select circuit 96 and a hammer drive circuit 98, all of which are coupled to each other, and to the machine controller 90 and the hammer 92. Since the hammer operating circuitry plays no part in the present invention except for providing an initiating signal on line 99 to the ribbon advance timer 100, it will not be described in additional detail.

The machine controller 90 is also coupled to a ribbon advance complete circuit 102, to provide to a comparator in said circuit a value representing the length of ribbon which should be advanced during a printing operation. It will be recalled that the shaft encoder 56 measures the length of ribbon actually fed during a printing operation. The encoder 56 is coupled to a ribbon advance counter 104, which provides a signal value corresponding to the distance measured by the encoder 56 to the ribbon advance complete circuit 102.

The ribbon advance complete circuit 102 compares the values from the machine controller 90 and the ribbon advance counter 104 and provides a signal on the line 106 when these values are equal. As will subsequently be described in greater detail, operation of the ribbon advance timer 100 is initiated by a hammer operating signal from the hammer drive circuit 98, and is terminated by the signal on line 106 from the ribbon advance complete circuit 102. The ribbon advance timer 100 operates a ribbon motor drive circuit 108, which in turn operates the motor 74 for the take-up roll or spool 12.

The motor 72 for the supply roll or spool 10 is operated by a ribbon tension motor drive circuit 110 which is coupled to and controlled by a ribbon tension logic circuit 112. The ribbon tension logic circuit, in turn, is controlled by the ribbon tension sensors 76, 78, which detect any slack in the ribbon 24 as it is fed from the supply roll 10 to the take-up roll 12, and is also controlled by a ribbon tension delay circuit 114. The ribbon tension delay circuit 114 is operated by the ribbon advance timer 100 and interposes a delay between termination of operation of the take-up roll motor 74 and the initiation of operation of the supply roll motor 72, in order to eliminate the possibility of ribbon breakage by simultaneous operation of both motors in opposite directions.

The circuit diagram of FIGS. 7A and 7B will now be described. As shown on the left side of FIG. 7A, the input information from the machine controller 90 is applied to inputs P0 to P6 inclusive of a comparator 120 which comprises the ribbon advance complete circuit 102. The comparator 120 may be, for example, of type 74ALS519, manufactured by Texas Instruments, Inc., Dallas, TX.

Information as to the amount of ribbon actually fed is provided by the shaft encoder 56 and is applied to a counter 122 which comprises the ribbon advance counter 104. The counter 122 may be, for example, of type MC14024 manufactured by Motorola Semiconductor Products, Inc., Phoenix, AZ. The outputs Q1 to Q7 of the counter 122 are applied to inputs Q0 to Q6 of the comparator 120. It will be noted that inputs P7 and Q7 of the comparator 120 are grounded. The P=Q output signal of the comparator 120 is applied to an inverter 124, which may be of type 7405, manufactured, for example, by Motorola. This signal is inverted and applied to the reset terminal of a one shot device 126, which comprises the ribbon advance timer 100. The device 126 may be of type 9602, manufactured, for example, by Motorola.

The hammer fire signal which appears on line 99 (FIG. 5) is applied to an inverter 128, which may be of type 7405. The signal is inverted by the inverter 128 and is applied to a second input of the one shot device 126. Said second input of the device 126 is also connected to a source of +5-volts potential via a 1000-ohm resistor 130. The maximum time duration of a pulse output from the device 126 is controlled by a circuit which extends from a +5-volt source of potential through a 12,000-ohm resistor 132 in series with a 50,000-ohm potentiometer 134 to a third terminal of the device 126, and over a 10-microfarad capacitor 136 to a fourth terminal of said device. Maximum pulse duration can be altered by adjustment of the potentiometer 134, and will normally be greater than the maximum time expected from the start of operation of the motor 74 until the amount of ribbon determined by the machine controller 90 has actually been fed.

The output of the ribbon advance timer one shot device 126 is applied via a line 136 to the reset terminals of the devices 120 and 122. It is also applied to the input of a one shot device 138 which comprises the ribbon tension delay circuit 114 and to an AND gate 168, as will be subsequently described in greater detail. In addition, the output of the one shot device 126 is applied to the input of an inverter 140, which may be of type 7405. The output of the inverter 140 is connected to a +5-volt source of potential via a 1000-ohm resistor 142 and is also connected to the ribbon take-up motor drive circuit 108 which comprises a diode 144, which may be of type 1N914, for example, manufactured by Motorola; an 820-ohm resistor 146; and a pair of NPN transistors 148 and 150. The diode 144 and the resistor 146 are connected in series, and are connected to the base of the transistor 148. The diode 144 protects the inverter 140 from current surges from the motor drive circuit 108. The transistors 148 and 150 may be of type 2N5069, manufactured, for example, by Motorola, and are connected in current amplifier configuration (Darlington pair), with the collectors connected at a node 152, the emitter of the transistor 148 connected to the base of the transistor 150, and the emitter of the transistor 150 connector to ground.

The ribbon take-up motor 74 is connected to the node 152 and to a source of potential of +28 volts. A diode 154, which may be of type 1N5139, manufactured, for example, by Motorola, is connected in parallel with the motor between the node 152 and the source +28-volt potential. This diode provides suppression of transients and drains transient current back to the power supply.

Returning now to the one shot device 138, the trigger input of that device is coupled to the Q/output of the one shot device 126. As has been previously mentioned, the one shot device 138 comprises the ribbon tension delay circuit 114 (FIG. 5), and the Q/output of the device 138 provides the ribbon tension delay signal. The reset input of the device 138 is connected via a 1000-ohm resistor 156 to a source of +5-volt potential. The duration of the ribbon tension delay signal can be altered by adjustment of a potentiometer 158 which is included in a circuit coupled to the inputs designated 14 and 15 of the device 138. Said circuit extends from an +5-volt source of potential and includes the potentiometer 158, as applied to the input 14. A 10-microfarad capacitor 160 is included in a second circuit branch from the potentiometer 158 to the input 15.

The ribbon tension logic circuit 112 (FIG. 5) includes, in FIG. 7B, two inverters 162, 164; a two-input OR gate 166; a three-input AND gate 168; and an inverter 170. The inverters 162, 164 and 170 may be of type 7405; the OR gate 166 may be of type 7432, manufactured, for example, by Motorola; and the AND gate 168 may be of type 7411, manufactured, for example, by Motorola.

The signals $S_1$and $S_2$applied, respectively, to inverters 162 and 164, are derived from the sensors 76, 78. The output of the inverter 162 is coupled to a +5-volt source of potential via a 1000-ohm resistor 172, and the output of the inverter 164 is coupled to a +5-volt source of potential via a 1000-ohm resistor 174.

The inverted signals from the inverters 162 and 164 are applied to the inputs of the OR gate 166, and the output of said OR gate, in turn, is applied to one input of the three-input AND gate 168. A second input to said AND gate is connected to the line 136, which in turn is connected to the output of the one shot device 126. The third input to said AND gate is connected to the Q/output of the one shot device 138.

The output of the AND gate 168 is inverted by the inverter 170. The output of said inverter is coupled to a +5-volt potential via a 1000-ohm resistor 176. Said output is also connected to the ribbon tension motor drive circuit 110, which comprises a diode 178, which may be of type 1N914, for example, manufactured by Motorola; an 820-ohm resistor 180; and a pair of NPN transistors 182 and 184. The diode 178 and the resistor 180 are connected in series, and are connected to the base of the transistor 182. The diode 178 protects the inverter 170 from current surges from the motor drive circuit. The transistors 182 and 184 may be of type 2N5069, and are connected in current amplifier configuration (Darlington pair), with the collectors connected at a node 186, the emitter of the transistor 182 being connected to the base of the transistor 184, and the emitter of the transistor 184 being connected to ground. The ribbon tension motor 72 is connected to the node 186 and to a source of potential of +28 volts. A diode 188, which may be of type 1N5139, is connected in parallel with the motor 72 between the node 186 and the source of +28-volt potential. This diode provides suppression of transients and drains transient current back to the power supply.

Operation of the ribbon feed control apparatus of the present invention will now be described. The ribbon feed mechanism is prepared for operation by placement of fresh ribbon 24, such as MICR ribbon, in the shape of a spool, on supply spool or roll 10. The ribbon 24 is run along the ribbon path defined by the rolls 28, 30, the printing station 38, the rolls 32, 34, 52 and 36 to the take-up roll 12, where it is attached to the core 22 of the spool 12. The ribbon 24 is guided past the typewheel assembly or printing station 38 in such a manner that the non-ink side is almost in contact with the characters on the typewheel assembly and the ink side is facing the document 40.

To advance the ribbon 24, the take-up motor 74 is energized through the ribbon advance timer 100 and the ribbon motor drive circuit 108. Initiation of motor operation takes place on the trailing edge of the hammer fire signal 190 (FIG. 5). Said trailing edge causes the output waveforms 192 and 194 for the ribbon advance timer 100 and the ribbon advance motor drive circuit 108, respectively, to shift to a low or false logic level. These waveforms remain at said logic level until the calculated amount of advance of the ribbon 24 has been completed, at which time the ribbon advance complete circuit 102 provides a positive-going pulse, as shown in waveform 196.

The amount or length of ribbon to be advanced depends upon the number of characters to be printed on the document 40. The machine controller 90 will have received this information prior to the time that the document 40 is moved into position for being printed upon at the print station 38. That information is entered in binary form on the inputs P0 to P6 of the comparator 120. It will be noted that since the ribbon is advanced at the trailing edge of the hammer fire pulse, there is always fresh ribbon in front of the typewheel before the hammer fires.

The ribbon advance motor 74 rotates the ribbon take-up spool or roll 12 in a clockwise direction as viewed in FIG. 1. Since no drive current is applied to the ribbon tension supply roll motor 72 at this time, the fresh ribbon 24 is pulled or advanced freely from the supply roll 10 along the ribbon path, and ribbon which has moved past the print station 38, and is therefore used, is wound on the take-up roll 12.

As the ribbon 24 moves over the pulley 52, the shaft encoder, comprising the timing disc 56 and the sensor 58, indicates the actual amount or distance that the ribbon 24 has been advanced. An example of typical ribbon advance, in a printing apparatus such as might be used with the ribbon feed control apparatus of the present invention with a timing disc 56 having 100 radial lines is four pulses per character to be printed. This number will obviously be different for different discs and pulley sizes.

As the ribbon 24 continues to advance, the ribbon advance counter 104 continues to accumulate counts from the shaft encoder 56 and the outputs of the counter 104 are placed in binary data form on the lines Q0 to Q6 (FIG. 7A) associated with the comparator 120 which comprises the ribbon advance complete circuit 102. When the correct amount of ribbon 24 has advanced, the comparator 120 puts the P=Q line high, as seen in waveform 196 of FIG. 6. The leading edge of this signal terminates the signal output by the ribbon advance timer 100, as shown by waveform 192, which in turn switches off the ribbon motor drive circuit 108, as shown by waveform 194.

On the trailing edge of the ribbon advance timer pulse 192, the ribbon tension delay circuit 114 is activated, as shown by waveform 198. The duration of this delay is adjusted to the application as required by adjustment of the setting of the potentiometer 158 (FIG. 7A), as previously described.

Figure 6:
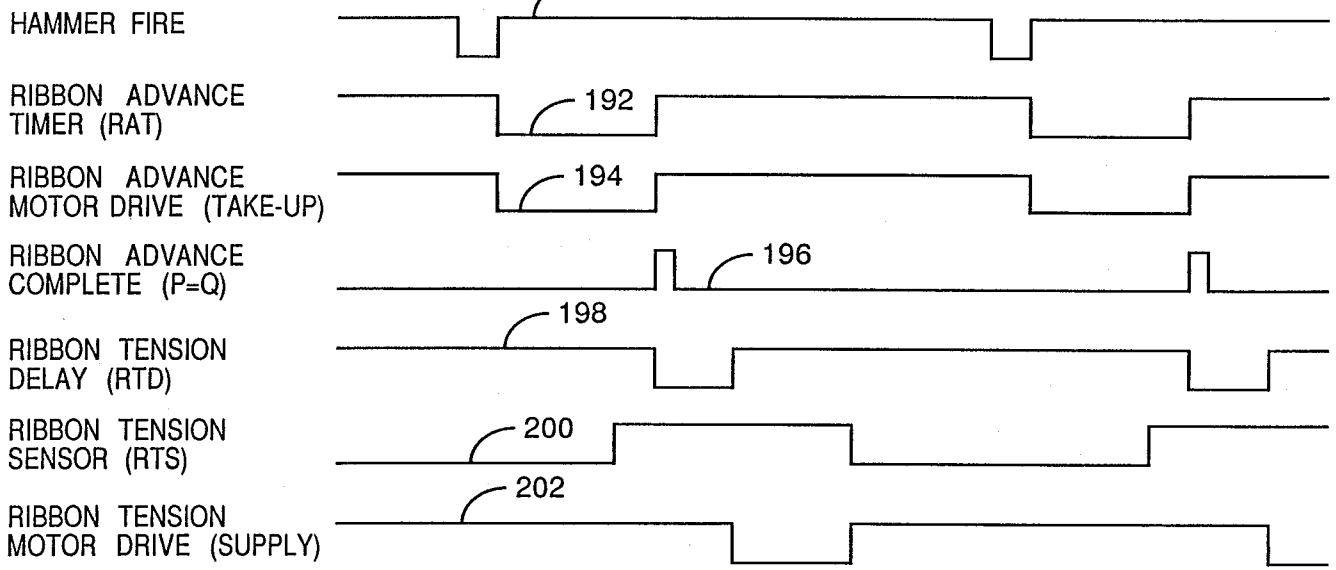
FIG. 6 is a diagram showing waveforms of various signals which are employed in the operating circuitry.

When the ribbon advance motor 74 is switched off, the ribbon supply roll 10 may still be turning, due to the inertia of the ribbon mass, which would cause the feeding of more ribbon 24 than is required. When this happens, the ribbon 24 becomes slack along the path defined by the pulleys 28, 30, 32, 34, 52 and 36. One or both of the sensors 76 and 78 change their signal level because the ribbon 24 no longer blocks the path between the light source and the light detector. The signals generated by the sensors 76 and 78 are utilized by the OR gate 166 (FIG. 7B) to produce the signal RTS, having a waveform 200 (FIG. 6). The signal RTS is combined in the AND gate 168 with the output signal 192 from the ribbon advance timer 100 and the output signal from the ribbon tension delay circuit 114. This signal is inverted by the inverter 170 to provide the output signal 202 which is applied to the ribbon tension motor drive circuit 110 to drive the ribbon supply motor 72. The ribbon supply motor 72 turns the fresh ribbon supply roll 10 in a counterclockwise direction and winds the loose and unused ribbon back onto the supply roll 10. At the instant that the ribbon 24 returns to its proper degree of tension, the sensors 76, 78 become blocked and the ribbon tension sensor signal RTS, represented by waveform 200, goes low. This in turn causes the ribbon tension motor drive signal, represented by waveform 202, to change logic levels, and terminates operation of the ribbon supply motor 72.

It should be noted that when the ribbon advance motor 74 is energized, the ribbon advance timer signal RAT, represented by waveform 192, is in an active low state, and the ribbon supply motor 72 is therefore disabled, by virtue of the ribbon tension logic circuit 112. In addition, the ribbon tension delay signal (waveform 198) only becomes active on the trailing edge of the ribbon advance timer signal. The ribbon supply motor 72 can only be energized after the expiration of the ribbon tension delay period. This insures that there can never be a situation in which both motors 72 and 74 are operating at the same time. Also, of course, the ribbon supply motor 72 can only be energized if a slack ribbon condition exists and is detected by one or both of the sensors 76 and 78. It will be obvious that more than two sensors could be used, if desired, due to the length or configuration of the path of travel of the ribbon 24 between the supply roll 10 and the take-up roll 12.

While the form of the invention described and illustrated herein is admirably adapted to fulfill the objects aforesaid, it is to be understood that other and further modifications within the scope of the appended claims may be made without departing from the spirit of the invention.

What is claimed is:

1. Ribbon feed control apparatus comprising:

apparatus support means;

ribbon supply means on which a supply of ribbon may be placed, said ribbon supply means being rotatably mounted on said apparatus support means;

ribbon take-up means rotatably mounted on said apparatus support means;

first drive means for driving said ribbon take-up means in a first direction of rotation;

ribbon advance timer means for controlling operation of said first drive means;

second drive means for driving said ribbon supply means in a second direction of rotation;

ribbon tension means for controlling operation of said second drive means;

guide means for guiding said ribbon in a path from said ribbon supply means to said ribbon take-up means;

control means for providing information as to the distance which said ribbon is to be advanced during a given operation;

measuring means for measuring the distance which said ribbon is actually advanced during a given operation;

comparison means coupled to said control means, said measuring means and said ribbon advance timer means for providing a halt signal to said ribbon advance timer means when ribbon distance information provided by said control means and by said measuring means are equal;

adjustable delay means comprising coupled resistor means, including a potentiometer, and capacitor means for determining time duration, said adjustable delay means being controlled by said ribbon advance timer means for controlling initiation of operation of said ribon tension means after a predetermined time period greater than zero following termination of operation of said first drive means; and ribbon tension sensing means coupled to said ribbon tension means for causing operation of said ribbon tension means when said ribbon in said path between said ribbon supply means and said ribbon take-up means is slack, whereby said ribbon tension means is operable to operate said second drive means to drive said ribbon supply means in said second direction of rotation to take-up said slack after expiration of said predetermined time period greater than zero.

* * * * *

UNITED STATES PATENT AND TRADEMARK OFFICE

CERTIFICATE OF CORRECTION

PATENT NO. : 4,878,773

DATED : November 7, 1989

INVENTOR(S) : Ali T. Mazumder

It is certified that error appears in the above-identified patent and that said Letters Patent is hereby corrected as shown below:

Column 9, line 4, delete "ribon" and substitute --ribbon--.

Column 10, line 6, delete "take-up" and substitute --take up--.

Signed and Sealed this

Eighteenth Day of September, 1990

*Attest:*

HARRY F. MANBECK, JR.

*Attesting Officer*

*Commissioner of Patents and Trademarks*